US008359794B2

(12) United States Patent
Biro et al.

(10) Patent No.: US 8,359,794 B2
(45) Date of Patent: Jan. 29, 2013

(54) EXTRUDED PLASTIC MEMBERS FOR COVERING WOOD SURFACES

(76) Inventors: Walter Biro, Boca Raton, FL (US); Sean Biro, Boca Raton, FL (US); David Swinscoe, Pompano Beach, FL (US); Lucky Monroe, Naples, FL (US)

( * ) Notice: Subject to any disclaimer, the term of this patent is extended or adjusted under 35 U.S.C. 154(b) by 0 days.

(21) Appl. No.: 12/927,106

(22) Filed: Nov. 5, 2010

(65) Prior Publication Data

US 2012/0110941 A1 May 10, 2012

Related U.S. Application Data

(60) Provisional application No. 61/258,137, filed on Nov. 4, 2009.

(51) Int. Cl.
*E04F 15/00* (2006.01)
*E04B 5/02* (2006.01)

(52) U.S. Cl. ..... 52/177; 52/588.1; 52/179; 52/506.01

(58) Field of Classification Search ..... 52/483.1, 52/650.3, 588.1, 592.1, 591.4, 223.1, 539, 52/223.6, 223.7, 177, 179, 506.01; 403/363, 403/331; 296/218, 219
See application file for complete search history.

(56) References Cited

U.S. PATENT DOCUMENTS

| | | | | | |
|---|---|---|---|---|---|
| 966,133 | A | * | 8/1910 | Staples | 52/179 |
| 3,394,515 | A | * | 7/1968 | Widdowson | 52/394 |
| 3,759,005 | A | * | 9/1973 | Smith | 52/396.04 |
| 4,266,382 | A | * | 5/1981 | Tellman | 52/316 |
| 4,905,431 | A | * | 3/1990 | Davis | 52/179 |
| 4,907,387 | A | | 3/1990 | Turnbull | |
| 4,951,992 | A | * | 8/1990 | Hockney | 296/204 |
| 5,134,825 | A | * | 8/1992 | Berridge | 52/520 |
| 5,170,605 | A | * | 12/1992 | Huddle | 52/588.1 |
| 5,794,390 | A | | 8/1998 | Oliveri et al. | |
| 5,816,010 | A | * | 10/1998 | Conn | 52/588.1 |
| 5,819,490 | A | * | 10/1998 | Current | 52/588.1 |
| 5,904,011 | A | * | 5/1999 | Biro | 52/177 |
| 5,913,784 | A | | 6/1999 | Hite | |
| 6,018,925 | A | | 2/2000 | Biro | |
| D421,502 | S | | 3/2000 | Felch et al. | |
| 6,112,479 | A | * | 9/2000 | Andres | 52/177 |
| 6,170,212 | B1 | * | 1/2001 | Suchyna et al. | 52/480 |
| 6,170,214 | B1 | * | 1/2001 | Treister et al. | 52/511 |
| 6,427,395 | B1 | | 8/2002 | Elsasser et al. | |
| 6,453,630 | B1 | | 9/2002 | Buhrts | |
| 6,584,748 | B2 | | 7/2003 | Bresnahan | |
| 6,637,163 | B2 | * | 10/2003 | Thibault et al. | 52/177 |
| 7,007,437 | B2 | | 3/2006 | Thomas | |

(Continued)

FOREIGN PATENT DOCUMENTS

| | | | | |
|---|---|---|---|---|
| JP | 06101321 | A | * | 4/1994 |
| JP | 06280370 | A | * | 10/1994 |

OTHER PUBLICATIONS

Translation of JP 6101321.*

*Primary Examiner* — Robert Canfield
*Assistant Examiner* — Brent W Herring
(74) *Attorney, Agent, or Firm* — Ronald V. Davidge

(57) ABSTRACT

A substrate covering system includes a plurality of elongated board members, which are, for example composed of an extruded thermoplastic material. Preferably, each of the elongated board members has a convex inner surface and a concave outer surface, both of which are flattened as the edges of the board member are attached to the substrate. Preferably, the inner surface has notches facilitating adhesive attachment to the substrate, while the outer surface has grooves curved to simulate a wood grain and to prevent slipping. The system may also include an elongated edge trim strip that can be configured to cover several different types of substrate edges.

10 Claims, 5 Drawing Sheets

U.S. PATENT DOCUMENTS

| | | | | |
|---|---|---|---|---|
| D564,106 | S | 3/2008 | Amato | |
| 7,406,801 | B2 * | 8/2008 | Zeng et al. | 52/177 |
| 7,415,801 | B2 * | 8/2008 | Zeng et al. | 52/177 |
| 7,634,882 | B1 * | 12/2009 | Briggs et al. | 52/520 |
| 7,900,416 | B1 * | 3/2011 | Yokubison et al. | 52/592.1 |
| 7,963,083 | B1 * | 6/2011 | Briggs et al. | 52/520 |
| 2003/0221770 | A1 * | 12/2003 | Meixner et al. | 156/230 |
| 2004/0079041 | A1 * | 4/2004 | Bergeron et al. | 52/489.1 |
| 2004/0163343 | A1 * | 8/2004 | Crocenzi | 52/371 |
| 2005/0055937 | A1 * | 3/2005 | Zimmerle et al. | 52/506.01 |
| 2006/0150539 | A1 * | 7/2006 | Vanhastel et al. | 52/179 |
| 2007/0193175 | A1 * | 8/2007 | Hao | 52/506.01 |
| 2009/0252925 | A1 * | 10/2009 | Provoost et al. | 428/151 |
| 2009/0260307 | A1 * | 10/2009 | Thiers | 52/309.1 |

* cited by examiner

EXTRUDED PLASTIC MEMBERS FOR COVERING WOOD SURFACES

RELATED APPLICATIONS

This application claims the benefit of U.S. Provisional Patent Application No. 61/258,137, filed Nov. 4, 2009.

FEDERALLY SPONSORED RESEARCH OR DEVELOPMENT

Not Applicable

BACKGROUND OF THE INVENTION

1. Field of the Invention

This invention relates to extruded plastic materials for covering wood or cement surfaces of boat docks and residential decks, and, more particularly, to providing such extruded plastic materials with surfaces preventing slip and fall accidents under wet conditions.

2. Summary of the Background Information

Many boat docks and residential decks are comprised of a wooden floor, made of individual planks, nailed in place over a wooden framework. One problem with this type of construction arises from the fact that the upper surface of the floor is exposed to ambient conditions which cause relatively rapid deterioration of the wood. In particular, the ultraviolet rays of sunlight cause deterioration of the wood near its surface, and moisture from dew, rain, or in the case of a boat dock, from splashing, aids in the initiation of rotting. While chemical preservatives often lengthen the usefulness of the wood flooring, the wood continues to deteriorate into a condition requiring replacement. During this process of deterioration, the appearance of the wood surfaces becomes aesthetically undesirable, and the flooring may become dangerous due to splintering and even collapsing. Thus, what is needed is a structure for covering the flooring of wood boat docks and residential decks to prevent deterioration of the wood. Such a structure would be especially useful if it could be used to cover wood flooring which has already been damaged by ambient exposure.

The patent literature includes a number of descriptions of configurations of extruded plastic materials for covering boat docks and residential decks. In some of these prior art configurations, elongated extruded sections are individually required to correspond to underlying planks, for example, with the extruded sections including flanges extending downward between the underlying planks. In some prior art configurations, mounting structures, including individual screw heads, must be covered by additional individual parts, increasing the cost and time required for installation of the materials. While adhesive bonding agents may be used to attach surfaces of prior-art plastic structures to adjacent wooden surfaces, it is noted that bonding agents often fail to bond securely to the smooth surfaces of such plastic structures.

SUMMARY OF THE INVENTION

In accordance with a first aspect of the invention, a system is provided for covering a substrate. The system includes a plurality of elongated board members attached to extend outward from the substrate. Each of the elongated board members includes a central portion with an outer surface and an inner surface, a first edge portion extending along a first side of the elongated board member and a second edge portion extending along a second side of the elongated board member, opposite the first side. The central portion is disposed between the first and second edge portions, and each of the elongated board members is attached to the substrate along the first edge portion and along the second edge portion Each of the elongated board members is configured before attachment to the substrate so that a contact surface forming part of the inner surface and held against the substrate, is convex, with a central portion of the contact surface, extending along the elongated board member mid-way between the first and second edge portions, being disposed substantially farther inward than edges of the contact surface extending along the first and second edge portions.

Preferably, each of the elongated board members is additionally configured before attachment to the substrate so that the outer surface is generally concave, with a central portion of the outer surface, extending along the elongated board member mid-way between the first and second edge portions, being disposed substantially further inward than edges of the outer surface extending along the first and second edge portions.

In accordance with another aspect of the invention, an elongated board member is provided, with the elongated board member including a central portion and first and second edge portions. The central portion has an outer surface and an inner surface including an inward facing contact surface and a plurality of notches extending along the inner surface, wherein each of the notches includes an outward facing adhesive attachment surface extending close to the inward facing contact surface. The first edge portion extends along a first side of the elongated board member, while the second edge portion extends along a second side of the elongated board member, opposite the first side. The central portion is disposed between the first and second edge portions.

Preferably, the outer surface outer surface includes a plurality of elongated grooves, each curved to extend both along and partly across the elongated board member. If the outer surface includes a plurality of spaced-apart ridges, extending parallel to the first edge portion, the elongated grooves extend into outermost surfaces of the spaced-apart ridges to a depth less than half the height of the ridges.

In accordance with yet another aspect of the invention, an elongated edge trim member is provided for use within a system covering a substrate. The system includes a fastening strip, an "L"-shaped clamping strip, and a substrate covering strip. The fastening strip, which extends along the elongated edge trim member, includes a plurality of slots, each extending along the elongated edge trim member. The "L"-shaped clamping strip extends outward from a first edge of the fastening strip to hold an edge portion of the system covering a substrate. The substrate covering strip extends inward from the first edge of the fastening strip to cover an edge portion of the substrate. The substrate covering strip is connected to the fastening strip by a thin section facilitating removal of the substrate covering strip from the fastening strip.

BRIEF DESCRIPTION OF THE FIGURES

These and other aspects of the invention will be made apparent by reading the following specification in conjunction with the accompanying drawings, in which.

DETAILED DESCRIPTION OF THE INVENTION

Figure 1:
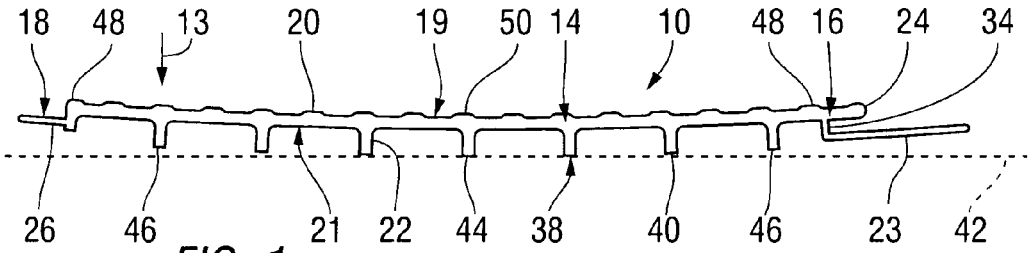
FIG. 1 is an end elevation of an elongated board member formed in accordance with the invention.
Figure 2:
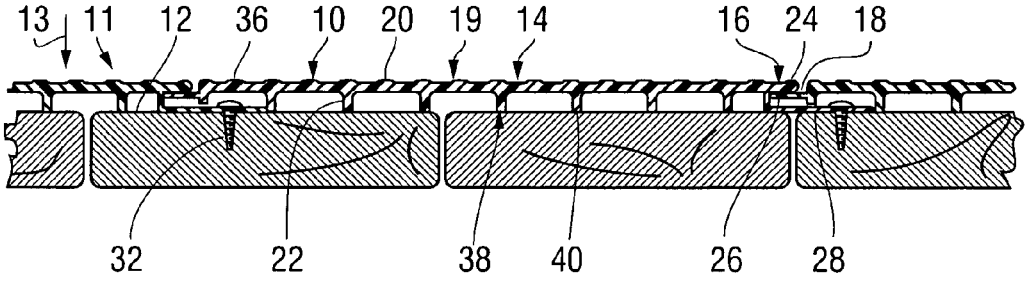
FIG. 2 is a fragmentary cross-sectional transverse elevation of a first embodiment of a substrate covering system, taken to show a plurality of the elongated board members of FIG. 1, interconnected with one another.
Figure 3:
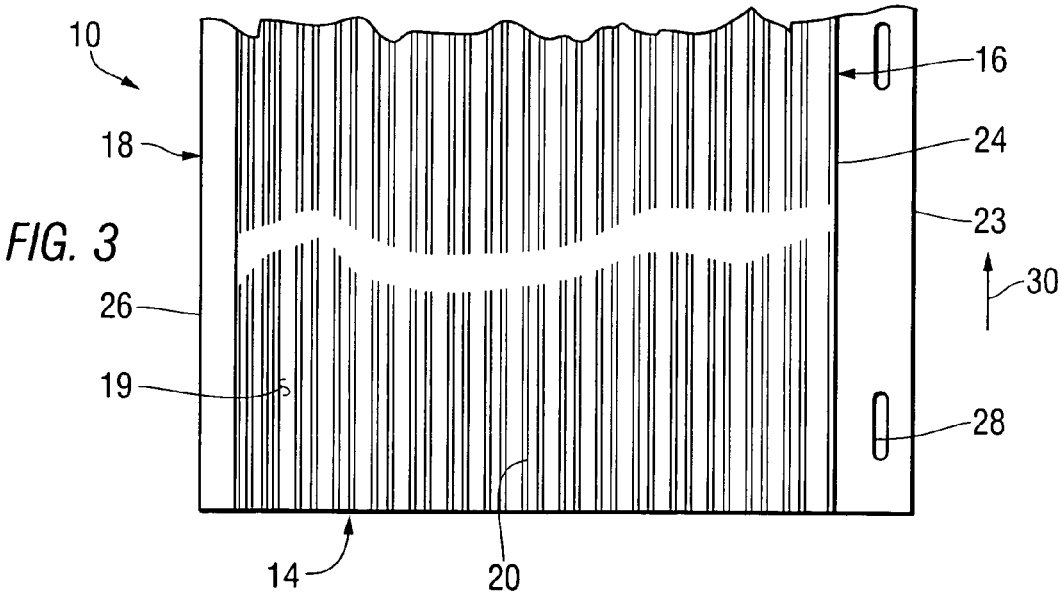
FIG. 3 is a fragmentary plan view of the elongated board member of FIG. 1.

Various features of a elongated board member 10 will first be discussed, with reference being made to FIGS. 1-3. FIG. 1 is an end elevation of the elongated board member 10, made in accordance with the invention, to be interconnected with other, similar, elongated board members 10 covering an existing surface. FIG. 2 is a fragmentary cross-sectional elevation of a a covering system 11 showing two of the elongated board members 10 interconnected to one another and installed on a wooden substrate 12. FIG. 3 is a fragmentary plan view of one of the elongated board members 10. It is noted that, while the substrate 12 is shown in a horizontal orientation, the covering system 11 may alternately be used to cover a substrate in a vertical orientation. Thus, as the terms are used herein, "inward" means in the direction of arrow 13, toward the substrate 12, while "outward" means away from the substrate, away from the direction of arrow 13. Since the elongated board member 10 is configured for installation on the substrate in a preferred orientation, these meanings are also applied to the elongated board member 10 before it is attached to the substrate, for example with "inward" meaning in the direction of the substrate to be subsequently attached to the elongated board member 10.

Referring first to FIG. 1, the elongated board member 10 includes a central portion 14, extending between a first edge portion 16 and a second edge portion 18, which lies parallel to the first edge portion 16. The central portion 14 includes an outer surface 19, having a plurality of ridges 20, and an inner surface 21, having a plurality of ribs 22. The first edge portion 16 includes an inner fastening strip 23, inwardly spaced from an outer fastening strip 24, while the second edge portion 18 includes an intermediate fastening strip 26.

Referring additionally to FIGS. 2 and 3, a plurality of fastening slots 28 are formed within the inner fastening strip 23, being spaced apart in the longitudinal direction of arrow 30 along the elongated board member 10 to provide points for attachment to a flat surface, such as the wooden substrate 12, using fasteners 32. These fastening slots 28 are slotted in the longitudinal direction of arrow 30 to prevent buckling by allowing for thermal expansion and contraction of the elongated board members 10 relative to the substrate 12 with changes in ambient temperature. The first and second edge portions 16, 18 are arranged so that, after the first edge portion 16 of one elongated board member 10 is fastened to the substrate 12, the intermediate fastening strip 26 of the second edge portion 18 of an adjacent elongated board 10 may be inserted within an intermediate groove 34 between the inner and outer fastening strips 22, 24 of the first edge portion 16. In this way, both the first edge portion 16 of one elongated board member 10 and the second edge portion 18 of another elongated board member 20 and held in place on the substrate 12 with a single row of fasteners 32. In this way, each of the elongated board members 10 is fastened in place on the substrate 20 by both the edge portions being held down on the substrate 20, and with the fasteners 32 being hidden from view by an overlying portion 36 of one of the elongated board members 10. An advantage is thus provided over prior art systems requiring the use of additional trim parts to cover fasteners.

FIG. 1 shows the elongated board member 10 as it is formed before attachment to the substrate 12, with a contact surface 38 that is inwardly exposed for attachment to the substrate 12 being convex, while the outer surface 19 is concave. (A straight dashed line 42 is added to FIG. 1 for comparison.) For example, the contact surface 38 includes a number of inward-facing contact surface portions 40, each of which is formed at an end of one of the ribs 22. A central portion 44 of the contact surface 38, extending along the elongated board member 10 mid-way between the first edge portion 16 and the second edge portion 18, is disposed substantially inward, in the direction of arrow 13, from edges 46 of the contact surface 28 extending adjacent the edge portions 16, 18. Furthermore, the upper surface 19 is concave, with a central portion 48 of the upper surface 19 extending along the elongated board member 10 mid-way between the edge portions 16, 18 being disposed substantially inward, in the direction of arrow 13, from edges 50 of the upper surface 19. Thus, when the elongated board member 10 is attached to a flat surface, such as the wooden substrate 12, to form the covering system 11 shown in FIG. 2, each of the ribs 23 along the inner surface 21 is rigidly held against the substrate 12. Since the ribs 23 are individually held against the substrate 23, contact between the individual ribs 23 and the substrate 12 is maintained despite minor variations in the flatness of the substrate 12. In this way, the ribs 23 are prevented from separating from the substrate 12, so that squeaking and clicking noises will not occur as a person walks along the covering system 11. Furthermore, as the elongated board member 10 is attached to the substrate 12, the concave shape of the outer surface 19 is reduced or eliminated.

For example, the elongated board member 10 is composed of a thermoplastic material, such as polyvinyl chloride, being formed by a plastic extrusion process, with the material being extruded onto a moving conveyer having a belt that is curved to form and retain the curved shape described above.

While the elongated board member 10 has been particularly configured for attachment to the substrate 12 using fasteners 32 as described in reference to FIGS. 2 and 3, it is understood that it is sometimes necessary or at least desirable to attach the elongated board member 10 to a substrate 12 using a contact adhesive. For example, a contact adhesive may be used if the substrate is composed of a material that is too difficult to prepare for use with mechanical fasteners or if a portion of the substrate is missing in a location where fasteners would be placed. Prior art elongated board members have smooth flat or rounded contact surfaces that rest on the surface of a substrate, making it difficult to securely bond the board members to a substrate surface with a contact adhesive, since the hardened adhesive material can be pulled away from the smooth surface of the board member.

Figure 4:
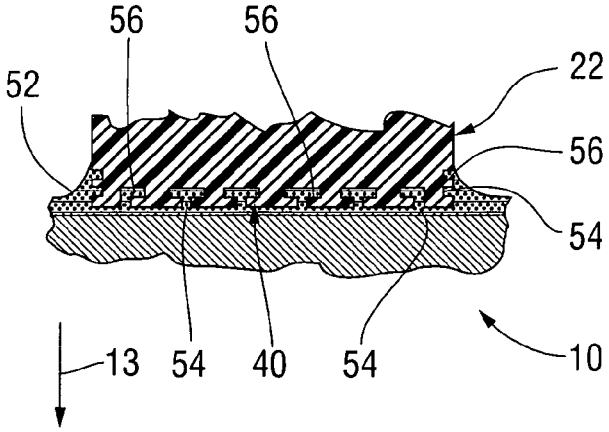
FIG. 4 is a fragmentary cross-sectional transverse elevation of the elongated board member of FIG. 1, showing a contact surface thereof.

FIG. 4 is a fragmentary cross-sectional transverse elevation of the elongated board member 10, showing the contact surface portion 40 of a rib 22, adhesively attached to a substrate 50 using an adhesive material 52. The contact surface portion 40 faces inward, in the direction of arrow 13. According to a preferred version of the invention, the elongated flooring member 10 is provided with a plurality of notches 54, each of which includes an adhesive attachment surface 56 facing outward, opposite the direction of arrow 13, allowing the formation of a strong adhesive connection between the elongated board member 10 and the substrate 50. For example, the elongated board member 10 is formed by a plastic extrusion process using a die forming the notches 54.

Figure 5:
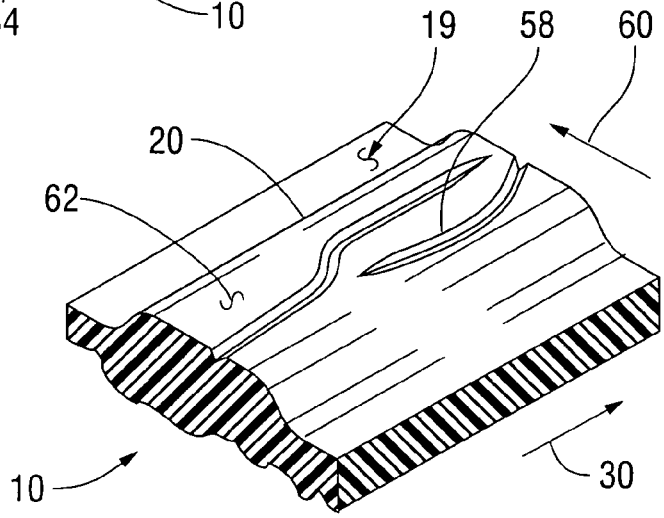
FIG. 5 is a fragmentary perspective view of the elongated board member of FIG. 1, showing grooves within an outer surface thereof.

FIG. 5 is a fragmentary perspective view of the elongated board member 10, showing a ridge 20 extending along the outer surface 19, which includes a plurality of grooves 58, which are each curved to extend both along the elongated board member 10, in the direction of arrow 30, and partly across the elongated member 10, in the direction of arrow 60. The grooves 58 extend into the outermost surface 62 of the ridge 20 to a depth less than half the height of the ridge. The grooves 56 are provided to simulate a wood grain and additionally to prevent slipping under wet conditions when the elongated board member 10 is used in a floor structure. Since all of the ridges 20 extend along the flooring member in the direction of arrow 30, curving the ridges to additionally extend in the direction of arrow 60 can prevent slipping along the board member 10. For example, the elongated board member 10 is formed by a plastic extrusion process in which material extruded through a die passes between a pair of rollers, one of which includes ridges forming the grooves 56.

Certain prior art elongated board members have grooves extending across ridges, but these grooves extend deeper than the height of the ridges, so that the ridges are completely severed by the grooves. The shallow grooves of the invention, as shown in FIG. 5, have the advantage of maintaining the structural integrity of the ridges, so that there is less tendency for the elongated board member 10 to warp during thermal cycles.

Figure 6:
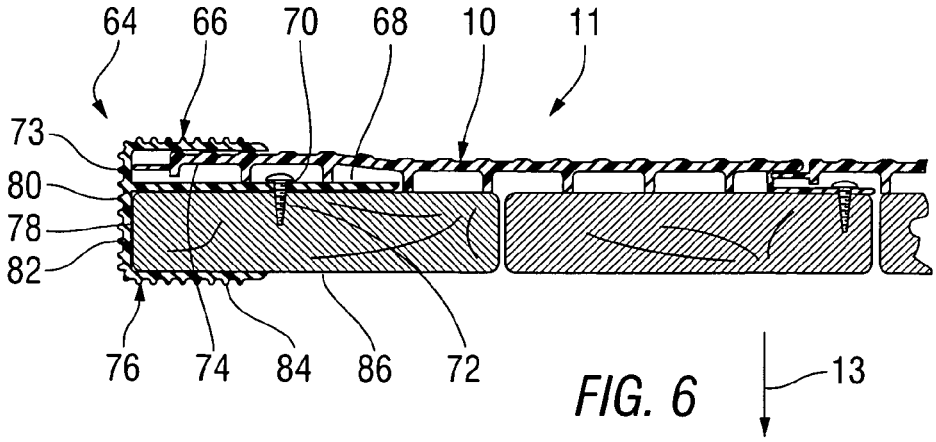
FIG. 6 is a fragmentary cross-sectional transverse elevation of the substrate covering system of FIG. 2, taken to show an edge thereof.

FIG. 6 is a fragmentary cross-sectional elevation of the substrate covering system 11, taken to show an edge 64 thereof, which is covered by an elongated edge trim member 66. The elongated edge trim member 66 includes a fastening strip 68 having a plurality of slots 70 through which fasteners 72 are attached to hold the elongated trim member 66 in place on the substrate 12. The elongated edge trim member 66 additionally includes an "L"-shaped clamping strip 73 that extends outward, opposite the direction of arrow 13 to hold an edge portion 74 of an adjacent elongated board member 10 against the fastening strip 68. Furthermore, the elongated edge trim member 66 includes a substrate covering strip 76, extending inward, in the direction of arrow 13, to cover an end 78 of the substrate 12, with the substrate covering strip 76 including a proximal portion 80 covering an end surface 82 of the substrate 12, while a distal portion 84 of the substrate covering strip 76 extends along an inner surface 86 of the substrate 12. The "L"-shaped clamping strip 73 of the elongated edge trim member 66 holds an edge portion 74 of an elongated board member 10 in place against the fastening strip 68 of the elongated edge trim member 66 by extending around the edge portion 74 without depending on the location of any specific features of the elongated board member 10. Therefore, the elongated edge trim member 66 may be used to hold down an edge portion of an elongated clamping member (not shown) that has been cut in two along its length to fit within a particular space.

Figure 7:
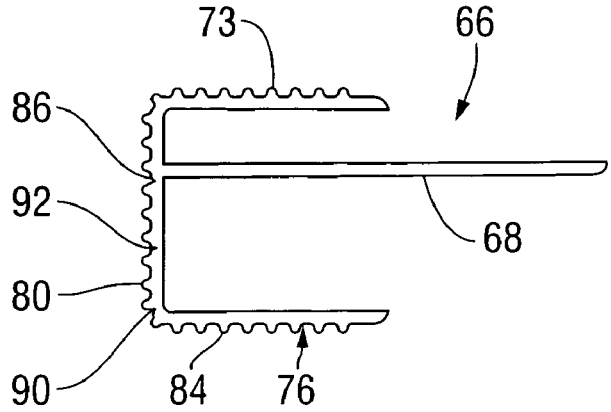
FIG. 7 is an end elevation of an elongated edge trim member of FIG. 6.

FIG. 7 is an end elevation of the elongated edge trim member 66, within which substrate covering strip 76 is connected to the fastening strip 68 by a thin section 88, providing for the easy removal of the substrate covering strip 76 from the fastening strip 68. Additionally, the distal portion proximal portion 80 and the distal portion 84 of the substrate covering strip 76 are connected to one another by a thin section 90, providing for the easy removal of the distal portion 84 from the proximal portion 80. Another thin section 92 may be provided for varying the distance through which the proximal portion 80 extends downward.

Figure 8:
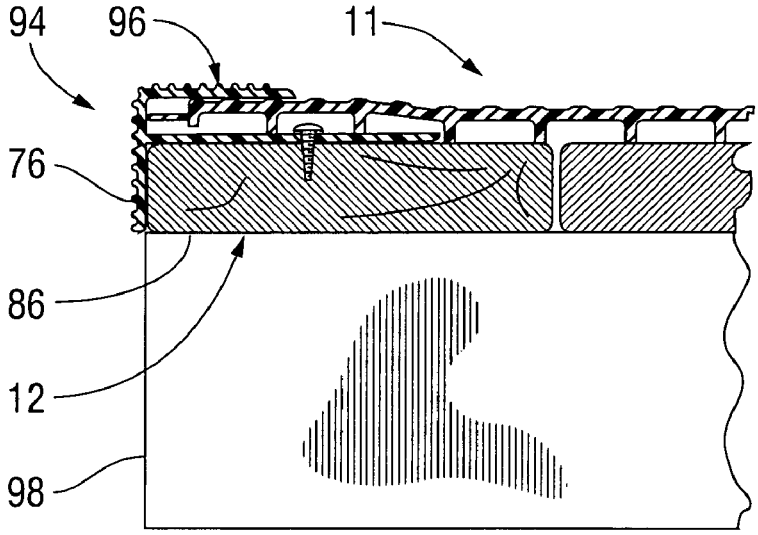
FIG. 8 is a fragmentary cross-sectional transverse elevation of the substrate covering system of FIG. 2, taken to show an edge thereof with the elongated edge trim member of FIG. 7 in a first alternate configuration.

FIG. 8 is a fragmentary cross-sectional transverse elevation of the substrate covering system 11, taken to show an edge 94 thereof, with the elongated edge trim member 66 in a first alternate configuration, indicated as 96, in which the distal portion 84 (shown in FIG. 7) of the substrate covering strip 76 has been removed, for example by repeatedly bending the thin section 90. This configuration 96 facilitates the use of the elongated edge trim member 66 when there structural elements 98 underlying the inner surface 86 of the substrate 12.

Figure 9:
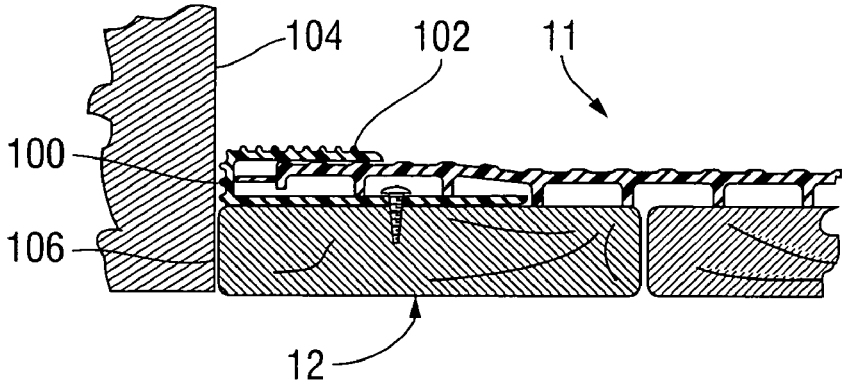
FIG. 9 is a fragmentary cross-sectional transverse elevation of the substrate covering system of FIG. 2, taken to show an edge thereof with the elongated edge trim member of FIG. 7 in a second alternate configuration.

FIG. 9 is a fragmentary cross-sectional transverse elevation of the substrate covering system 11, taken to show an edge 100 thereof, with the elongated edge trim member 66 in a second alternate configuration, indicated as 102, in which the substrate covering strip 76 has been removed, for example by repeatedly bending the thin section 88. This configuration facilitates the use of the elongated edge trim member 66 when an outwardly extending structure, such as a wall 104 is disposed at an edge 106 of the substrate 12. The ability to form various configurations of the elongated edge trim member 66, as explained above in reference to FIGS. 6-9, provides a significant advantage over prior-art floor covering systems in that a single type of part can be stocked for use in such varying circumstances.

Figure 10:
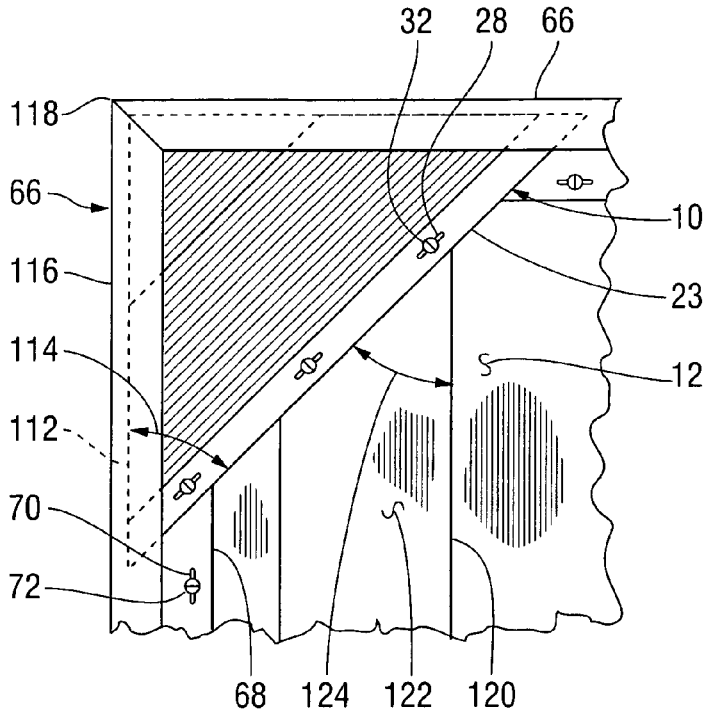
FIG. 10 is a fragmentary plan view of a substrate covering system under construction, including the elongated board member of FIG. 1 and the elongated edge trim member of FIG. 7.

FIG. 10 is a fragmentary plan view of a substrate covering system 110 under construction. Since the elongated edge trim members 66 do not depend on the location of specific features of the elongated board members 10 to hold down edge portions 112 thereof, as described above in reference to FIG. 6, these edge portions 112 are held in place when they are formed by cutting the elongated board members 10 at an acute angle 114, so that these elongated board members 10 will lie at the angle 114 relative to edges 116 of the substrate covering system 110. The process of building the substrate covering system 110 begins with installing the elongated edge trim members 66, using fasteners 72 extending through a plurality of slots 70. Then the elongated board members 10 are fastened into place one at a time, starting from a corner 118 of the substrate covering system 110, using fasteners 32 extending through a number of slots 28 in the elongated board member 10. Since, unlike various prior-art floor covering systems, the elongated board members 10 do not include features that must be aligned with the edges 120 of boards 122 within the substrate 12, the elongated board members 10 are readily installed at an acute angle 124 relative to these edges 120.

Figure 11:
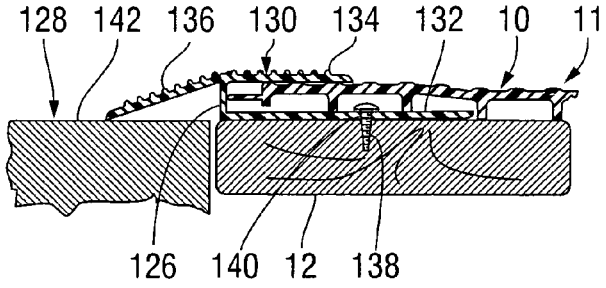
FIG. 11 is a fragmentary cross-sectional transverse elevation of the substrate covering system of FIG. 2, taken to show an edge thereof adjacent an uncovered surface.

FIG. 11 is a fragmentary cross-sectional transverse elevation of the substrate covering system 11, taken to show an edge 126 thereof adjacent an uncovered surface 128. For example, the uncovered surface 128 may be composed of concrete or stone. The edge 126 is covered by an elongated intermediate trim member 130 having a fastening strip 132, an "L"-shaped clamping strip 134, and a flexible edge strip 136. The fastening strip 132 is fastened to the substrate 12 by a plurality of fasteners 138 extending through slots 140. The "L"-shaped clamping strip 134 extends outward, opposite the direction of arrow 13, to hold an edge portion 74 of the elongated board member 10 against the fastening strip 132. The flexible edge strip 136 extends inward, in the direction of arrow 13, being held against an upper surface 142 of the uncovered surface 128.

Figure 12:
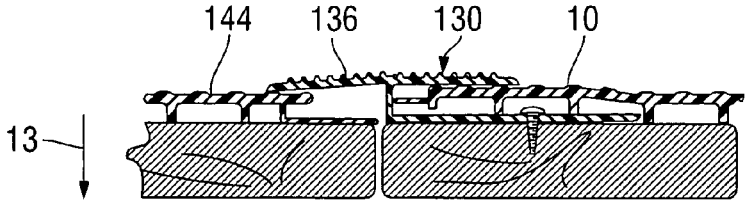
FIG. 12 is a fragmentary cross-sectional transverse elevation of the substrate covering system of FIG. 2, taken to show an elongated intermediate trim member therein.

FIG. 12 is a fragmentary cross-sectional transverse elevation of the substrate covering system 11, showing the elongated intermediate trim member 130 being used to connect two adjacent elongated board members 10. The flexible edge strip 136 is pulled upward from the position in which it is shown in FIG. 11 to rest against an adjacent surface 144 of one of the elongated board members 10.

Figure 13:
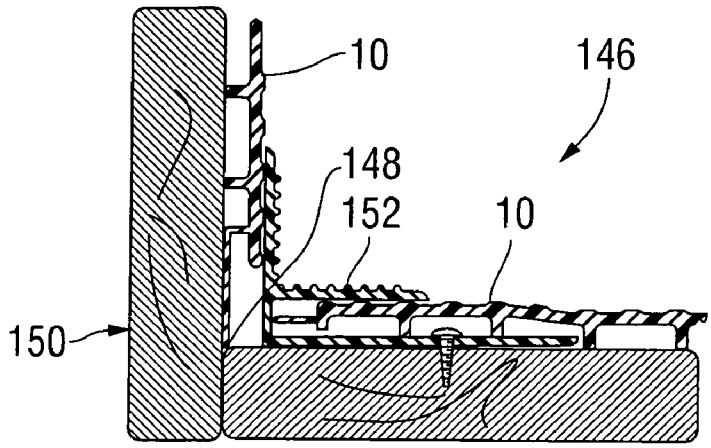
FIG. 13 is a fragmentary cross-sectional transverse elevation of a substrate covering system including a plurality of the elongated board members of FIG. 1 to cover an internal corner.

FIG. 13 is a fragmentary cross-sectional elevation of a substrate covering system 146 including a plurality of the elongated board members 10 covering an internal corner 148 in a substrate 150, which may comprise, for example, vertical surfaces of a building or a floor extending from a wall. The substrate covering system 146 includes an elongated corner trim strip member 152, which is configured to hold end portions 154 of two elongated board members 10.

Figure 14:
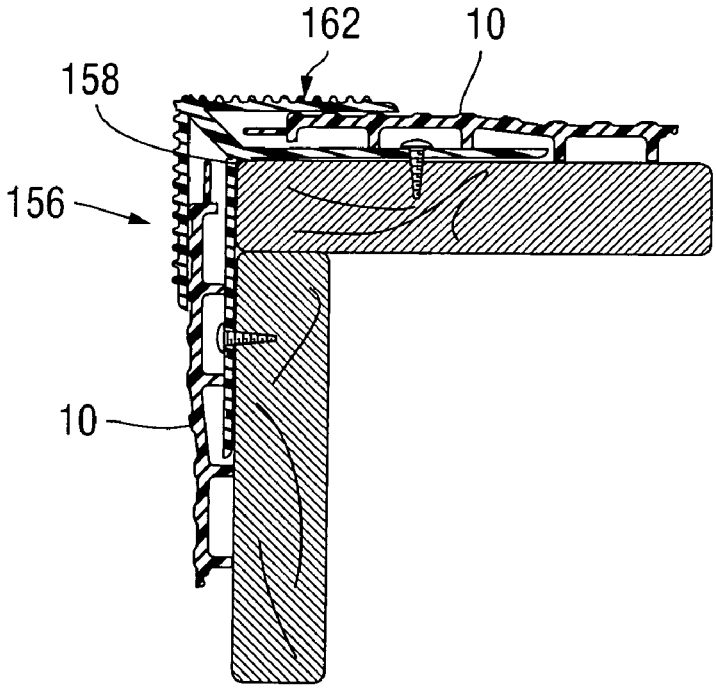
FIG. 14 is a fragmentary cross-sectional transverse elevation of a substrate covering system including a plurality of the elongated board members of FIG. 1 to cover an external corner.

FIG. 14 is a fragmentary cross-sectional elevation of a substrate covering system 156 including a plurality of the elongated board members 10 covering an external corner 158 in a substrate 160, which may comprise, for example, vertical surfaces of a building or of a rectangular post. The substrate covering system 156 includes an elongated corner trim strip member 162, which is configured to hold end portions 164 of two elongated board members 10.

Figure 15:
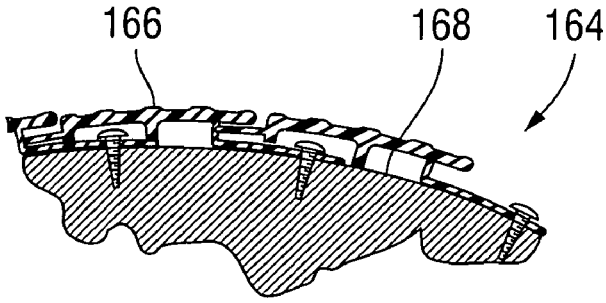
FIG. 15 is a fragmentary cross-sectional transverse elevation of a substrate covering system covering a rounded surface.

FIG. 15 is a fragmentary cross sectional elevation of a substrate covering system 164 including a plurality of curved elongated board members 166 to cover a rounded substrate 168, which may be part of a round post.

While the invention has been described in terms of preferred embodiment with some degree of particularity, it is understood that this description has been given only by way of example, and that many changes can be made without departing from the spirit and scope of the invention, as defined in the appended claims.

What is claimed is:

1. A system covering a substrate, comprising a plurality of elongated board members attached to extend outward from the substrate, wherein each of the elongated board members includes a central portion with an outer surface and an inner surface, a first edge portion extending along a first side of the elongated board member and a second edge portion extending along a second side of the elongated board member, opposite the first side, the central portion is disposed between the first and second edge portions, each of the elongated board members is attached to the substrate along the first edge portion and along the second edge portion, each of the elongated board members is configured before attachment to the substrate so that a contact surface forming part of the inner surface and held against the substrate, is convex, being entirely disposed along a single convex curve extending between the first and second edge portions, with a central portion of the contact surface, extending along the elongated board member mid-way between the first and second edge portions, being disposed substantially farther inward than edges of the contact surface extending along the first and second edge portions.

2. The system of claim 1, wherein the inner surface includes a plurality of spaced-apart ribs extending parallel to the first edge portion, each having an inward-facing contact surface portion forming a part of the contact surface, being held against a flat substrate when the first and second edge portions are held against the flat substrate.

3. The system of claim 2, wherein each of the spaced-apart ribs includes a notch, extending parallel to the contact surface and close to the contact surface, having an outward-facing surface and wherein each of the ribs is attached to the substrate by a contact adhesive filling the notch.

4. The system of claim 1, wherein each of the elongated board members is configured before attachment to the substrate so that the outer surface is generally concave, with a central portion of the outer surface, extending along the elongated board member mid-way between the first and second edge portions, being disposed substantially further inward than edges of the outer surface extending along the first and second edge portions.

5. The system of claim 4, wherein the outer surface includes a plurality of elongated grooves, each curved to extend both along and partly across the elongated board member.

6. The system of claim 5, wherein the outer surface includes a plurality of spaced-apart ridges, extending parallel to the first edge portion, and having outermost surfaces, the elongated grooves extend into the outermost surfaces of the spaced-apart ridges to a depth less than half the height of the ridges.

7. The system of claim 1, wherein the first edge portion includes an inner fastening strip, including a plurality of slots, each extending along the elongated board member, and an outer fastening strip, extending along the elongated board member, outwardly disposed from the inner fastening strip, forming an intermediate slot extending between the inner fastening strip and the outer fastening strip, the inner fastening strip is fastened to the substrate by a plurality of fasteners extending through the plurality of slots, and the second edge portion includes an intermediate strip, extending within the intermediate slot of the first edge portion of an adjacent elongated board member within the plurality of elongated board members, and being outwardly disposed from a plurality of fasteners extending through a plurality of slots in the adjacent elongated board member.

8. The system of claim 1, additionally comprising an elongated edge trim member including:

a fastening strip attached to the substrate; and an "L"-shaped clamping strip extending outward from a first edge of the fastening strip to hold an edge portion of an elongated board member in the plurality of elongated board members.

9. The system of claim 8, wherein the elongated edge trim member additionally includes a substrate covering strip, extending inward from the first edge of the fastening strip to cover an edge portion of the substrate.

10. The system of claim 9, wherein the substrate covering strip comprises a proximal portion and a distal portion connected to the proximal portion by a thin section facilitating removal of the distal portion from the proximal portion.

* * * * *